US005830293A

United States Patent [19]

Meyer et al.

[11] Patent Number: 5,830,293

[45] Date of Patent: Nov. 3, 1998

[54] METHOD OF COOLING STEEL SECTIONS WHICH ARE HOT FROM ROLLING

[75] Inventors: Meinert Meyer, Erkrath; Rainer Kohlmann, Siegen, both of Germany

[73] Assignee: SMS Schloemann-Siemag Aktiengesellschaft, 40237 Düsseldorf, Germany

[21] Appl. No.: 826,302

[22] Filed: Mar. 27, 1997

[30] Foreign Application Priority Data

Mar. 30, 1996 [DE] Germany ..... 196 12 818.9

[51] Int. Cl.[6] ..... C21D 8/00

[52] U.S. Cl. ..... 148/654; 148/660; 148/661; 148/663

[58] Field of Search ..... 148/654, 663, 148/660, 661

[56] References Cited

U.S. PATENT DOCUMENTS 4,016,009 4/1977 Economopoulos et al. ..... 148/654
4,592,788 6/1986 Tamm et al. ..... 148/663

*Primary Examiner*—Deborah Yee
*Attorney, Agent, or Firm*—Friedrich Kueffner

[57] ABSTRACT

A method of cooling steel sections which are hot from rolling by means of shock-like cooling following the rolling process so as to form a martensitic surface layer, and by subsequently autogenously tempering this surface layer by means of core heat to obtain a tough-resistant structure with an austenitic remaining cross-section, wherein the method is used in connection with types of steel which, with uncontrolled cooling in air, would directly transform from the austenitic phase into martensite because of their alloying elements from the group Cr, Mn, Mo, Ni and other suitable elements.

8 Claims, 1 Drawing Sheet

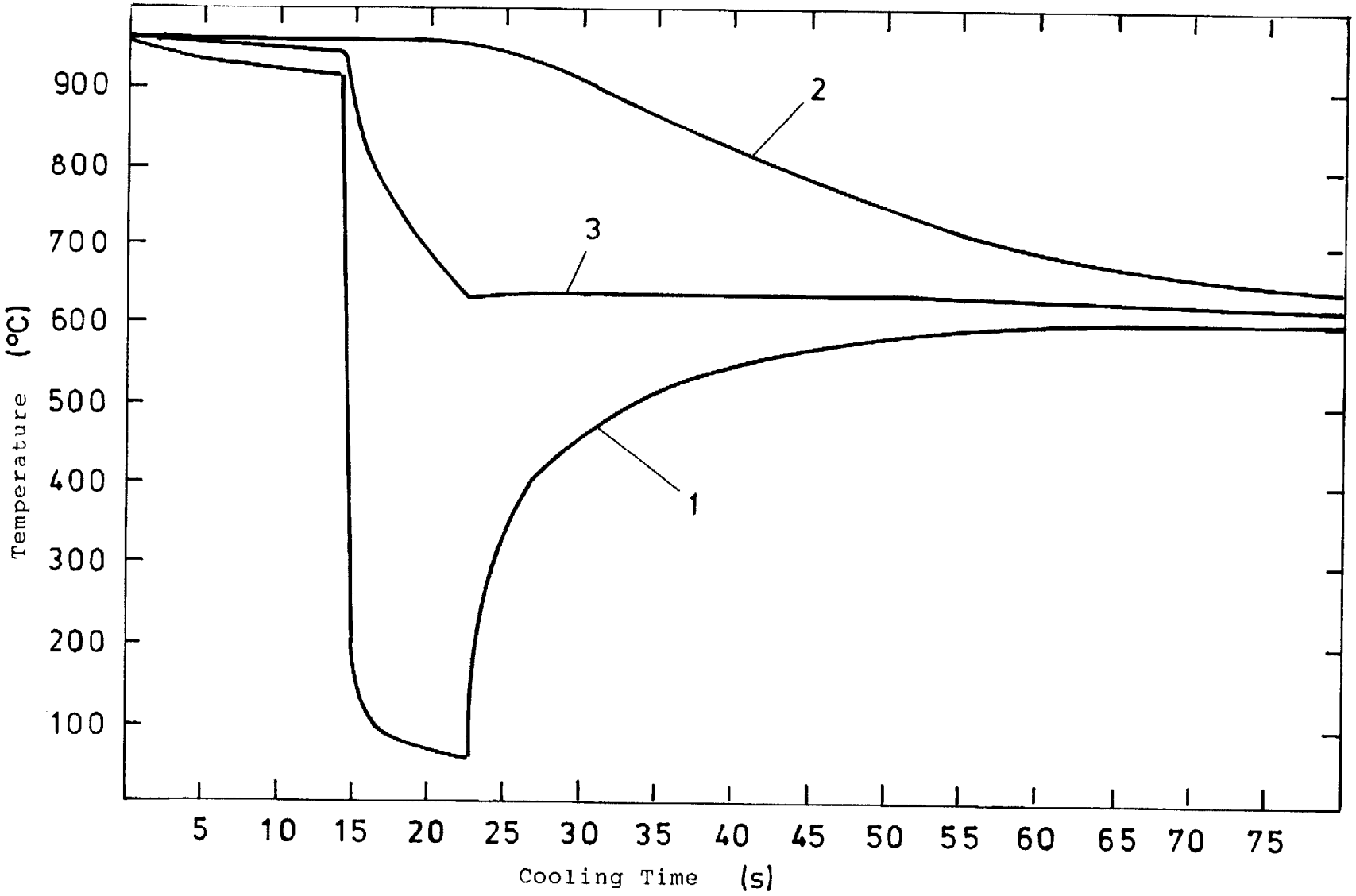
Temperature (°C)
900
800
700
600
500
400
300
200
100
Cooling Time (s)
5
10
15
20
25
30
35
40
45
50
55
60
65
70
75
1
2
3

METHOD OF COOLING STEEL SECTIONS WHICH ARE HOT FROM ROLLING

BACKGROUND OF THE INVENTION

1. Field of the Invention

The present invention relates to a method of cooling steel sections which are hot from rolling by means of shock-like cooling following the rolling process so as to form a martensitic surface layer, and by subsequently autogenously tempering this surface layer by means of core heat to obtain a tough-resistant structure with an austenitic remaining cross-section.

2. Description of the Related Art

Some types of steel, particularly the so-called high-grade steels, are very sluggish to transform because of the alloying elements contained therein, for example, of the group including Cr, Mn, Mo, Ni, and other suitable elements. In other words, the transformation from the austenitic phase after the hot deformation into ferrite or pearlite takes place only after long holding times at the appropriate temperature interval between 600° and 750° C.

If these steels are not purposely cooled slowly, sometimes over several days, and are not maintained at the appropriate transformation temperature, the austenite remains during further cooling, and after reaching the martensite starting temperature, will convert directly into martensite having a high hardness. This occurs essentially in steels having diameters of less than 100 mm during cooling after the transformation on the cooling bed in still air. This is the reason why these steels are also called air-hardening steels.

Aside from stainless heat-treatable steels containing, for example, 13% to 17% Cr, Mo, Ni and possible additions of other accompanying elements and carbon contents of between 0.2% and 0.6%, belonging to this group are also tool steels (e.g., 56NiCrMoV7) and special heat-treatable steels (e.g., 45CrMoV67) in the field of high-grade structural steels. These steels have a high hardenability which is why these steels are also considered to be among the air-hardening steels.

If steels having the aforementioned chemical composition are cooled to quickly and transform martensitically as a result, a hard and brittle transformation structure is obtained which makes it possible that stress cracks will form and brittle fractures will occur during later handling. Therefore, it is known in the art to convey steels of the group of the so-called air-hardening steels as quickly as possible after the transformation process to special devices which ensure a significantly delayed cooling. Preferably used for this purpose are holding hoods, holding pits with heating means and similar devices in order to collect lots obtained after the transformation into bundles and, after the unit is filled up, to carry out a purposeful cooling which may sometimes last several days. This means that substantial technical requirements must be met, for example, for a quick transport over the cooling bed or for a separate transverse transport in front of the cooling bed, and that insulating devices and thermal protection devices in the area of the rolling mill, hot cut-off devices, additional roller conveyors and particularly the holding devices themselves must be provided.

SUMMARY OF THE INVENTION

Therefore, it is the primary object of the present invention to avoid the technical requirements mentioned above which are very expensive and, simultaneously, to ensure that, after hot transformation and cooling to room temperature, the air-hardening steels can be made available for further use in a state of their structure which is without cracks and fractures and is in a condition suitable for further processing.

In accordance with the present invention, the method of cooling steel sections which are hot from rolling by means of shock-like cooling following the rolling process so as to form a martensitic surface layer and by subsequently tempering this surface layer by means of core heat to obtain a tough-resistant structure with austenitic remaining cross-section is used in connection with types of steel which, with uncontrolled cooling in air, would directly transform from the austenitic phase into martensite because of their alloying elements from the group Cr, Mn, Mo, Ni and other suitable elements.

The product which is hot from rolling is conveyed directly after the deforming process through a cooling stretch supplied with water, wherein a thin surface layer is cooled in such a way that it transforms martensitically. After emerging from the cooling stretch, this martensitic surface layer is autogenously tempered as a result of the residual heat of the string of the rolled product, so that a surface layer is produced which is very tough and is capable of absorbing high tensions, wherein the surface layer prevents damage in the form of cracks or fractures during the further conversion of the still present austenite into martensite.

Preferred is shock-like cooling with a heat transmission co-efficient alpha of greater than 20 $kW/m^2/K$, preferably up to 80 $kW/m^2/K$.

The present invention provides the significant advantage that steels from the group of the air-hardening steels do not require the complicated devices needed in the prior art for cooling with extremely long delays. This means that the efficiency of the cooling process is significantly improved and the productivity is increased because the cooling times are decreased.

In accordance with a further development of the invention, the shock-like cooling for forming the martensitic surface layer is carried out in a water cooling stretch arranged following the rolling train at a cooling beginning exactly defined by a predetermined starting temperature after the dynamic recrystallization and with a cooling pattern predeterminable by comparative tests to a defined cooling temperature.

A continuation off the method further advantageously provides that the cooling process of the steel section is initially ended after the tempering of the martensitic surface layer, the steel section is conveyed through the other processing units, is subsequently stored and, only when requested by a customer at a later time, is transformed by a specifically elected heat treatment into a structure specified by the customer for delivery.

This is very advantageous because different structure conditions or degrees of hardness, i.e., properties determined by later use, can be produced from the same type of steel depending on the purpose of use, for example, as spring steel, as cutting steel, as structural steel, etc.

A further development of the method according to the invention provides producing partial lengths from the string of rolling stock in accordance with a specific order, collecting the partial lengths into bundles at a temperature below possible carbide precipitation phases, further cooling the partial lengths at a cooling speed of less than 1K/min, and, in the transformation of the austenite which is still present, carrying out a low-stress transformation into a self-tempered martensite.

Following the cooling process, the steel may travel through the units provided for low-alloy steels and/or unalloyed steels for further processing into a defined condition as required for delivery. The advantage of this is that separate expensive additional devices are no longer required for this purpose. The steel cooled to room temperature can subsequently be subjected to the usual handling in further processing steps, without producing stress cracks or material fractures.

The method of cooling steel sections which are hot from rolling of a type of steel referred to as an air-hardening steel with alloy elements of the group Cr, Mn, Mo, Ni, V and other suitable elements is preferably suitable for use in connection with round material having diameters of less than 100 mm.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a diagram showing the pattern of temperature and cooling time for an air-hardening steel.

DESCRIPTION OF THE PREFERRED EMBODIMENTS

The diagram of the drawing shows the pattern of the temperature and cooling time for an air-hardening steel with temperature curves for the surface layer 1, for the core area 2, and for the average temperature 3.

The diagram corresponds to the thermal treatment of a sample according to the present invention and was carried out with a round section having a diameter of 62 mm and the chemical composition: C=0.40%; Mn=1.45%; Cr=2.0%; Mo=0.2%. The martensitic transformation of the surface layer was carried out by travel through a water cooling stretch with Tw=30° C. and a speed V=1.13 m/s.

The sample leaves the last roll stand with a rolling temperature of about 960° C. By the time the sample enters the cooling stretch, the dynamic recrystallization has been completely concluded.

The shock-like cooling of the sample begins in the cooling stretch at the 14th second, wherein the surface temperature (1) cools within about 2 seconds from 920° C. to about 200° C. and further to about 70° C. between the 15th second and the 23rd second.

The core temperature (2) drops much more slowly and is about 870° C. at the 35th second and about 640° C. at the 80th second.

The average temperature (3) drops from the 14th second to the 23rd second from 940° C. to about 640° C. and then drops approximately steadily to about 620° C.

After leaving the cooling stretch, the temperature of the surface layer (1) increases rapidly in accordance with an exponential function as a result of heat supplied from the core and reaches a temperature of about 610° C. up by the 80th second. This results in a very tough and resistant surface layer as a result of a tempering process in the surface layer, wherein this tough and resistant surface layer surrounds like a protective layer the initially still austenitic remaining cross-section and prevents damage to the material, such as cracks or fractures during the later transformation of the residual austenite into martensite.

The method according to the invention is uncomplicated and merely requires an exactly reproducible and controlled accelerated cooling of air-hardening alloy steels while not requiring the complicated devices for cooling with significant delay which in the past were necessary for air-hardening steels. Accordingly, the object of the present invention described above is met in an optimum manner.

While specific embodiments of the invention have been shown and described in detail to illustrate the inventive principles, it will be understood that the invention may be embodied otherwise without departing from such principles.

We claim:

1. In a method of cooling steel sections which are hot from rolling in a rolling process, the method including carrying out a shock-like cooling following the rolling process so as to form a martensitic surface layer and subsequently tempering the surface layer by means of core heat into a tough-resistant structure with an austenitic remaining cross-section, the improvement comprising carrying out the method in an air-hardening steel which, due to alloying elements from the group Cr, Mn, Mo, Ni and other suitable elements, are transformed when subjected to uncontrolled cooling in air directly from the austenitic phase into martensite.

2. The method according to claim 1, comprising carrying out the shock-like cooling without substantial delay in a controlled cooling step in devices provided therefor.

3. The method according to claim 1, comprising carrying out the shock-like cooling in a water cooling stretch arranged following a rolling train for forming the martensitic surface layer in accordance with a cooling pattern determined by comparative tests at a cooling beginning exactly defined by a starting temperature determined by the comparative tests after dynamic recrystallization to a cooling temperature.

4. The method according to claim 3, comprising carrying out the shock-like cooling with a heat transmission coefficient alpha of greater than 20 $kW/m^2/K$.

5. The method according to claim 3, comprising carrying out the shock-like cooling with a heat transmission coefficient alpha of up to 80 $kW/m^2/K$.

6. The method according to claim 1, comprising initially ending the cooling process of a steel section after autogenously tempering the martensitic surface layer thereof, conveying the steel section through additional processing units, and subsequently storing the section.

7. The method according to claim 6, comprising producing predetermined partial lengths from rolled stock in accordance with a specific order, collecting the partial lengths into bundles at a temperature below possible carbide precipitation phases, further cooling the partial lengths with a cooling speed of less than 1K/min, and carrying out a further transformation of still present austenite into autogenously tempered martensite by a low-stress transformation.

8. The method according to claim 1, wherein the steel section has a diameter of less than 100 mm.

* * * * *